US010065764B2

(12) United States Patent
Hassell et al.

(10) Patent No.: US 10,065,764 B2
(45) Date of Patent: Sep. 4, 2018

(54) BAKERY TRAY

(71) Applicant: Rehrig Pacific Company, Los Angeles, CA (US)

(72) Inventors: Jon P. Hassell, Atlanta, GA (US); Margaret McCanless, Dacula, GA (US); Kyle L. Baltz, Rossmoor, CA (US); Glenn E. Rindfleisch, Naples, FL (US)

(73) Assignee: Rehrig Pacific Company, Los Angeles, CA (US)

( * ) Notice: Subject to any disclaimer, the term of this patent is extended or adjusted under 35 U.S.C. 154(b) by 60 days.

(21) Appl. No.: 15/011,610

(22) Filed: Jan. 31, 2016

(65) Prior Publication Data

US 2017/0021965 A1 Jan. 26, 2017

Related U.S. Application Data

(63) Continuation of application No. 13/400,161, filed on Feb. 20, 2012, now Pat. No. 9,278,780.

(Continued)

(51) Int. Cl.

| | |
|---|---|
| ***B65D 21/02*** | (2006.01) |
| ***B65D 85/36*** | (2006.01) |
| ***B65D 71/70*** | (2006.01) |
| ***B65D 25/30*** | (2006.01) |
| ***B65D 1/34*** | (2006.01) |

(52) U.S. Cl.

CPC ..... *B65D 21/0212* (2013.01); *B65D 1/34* (2013.01); *B65D 21/0213* (2013.01); *B65D 25/30* (2013.01); *B65D 71/70* (2013.01); *B65D 85/36* (2013.01); *B65D 2585/36* (2013.01)

(58) Field of Classification Search

CPC ..... B65D 21/0212; B65D 21/0213; B65D 21/0215; B65D 21/043; B65D 1/34; B65D 71/70; B65D 85/36; B65D 2585/36; B65D 25/30

See application file for complete search history.

(56) References Cited

U.S. PATENT DOCUMENTS 4,402,408 A * 9/1983 Kreeger ..... B65D 21/041 206/507
4,936,458 A * 6/1990 Tabler ..... B65D 21/062 206/386

(Continued)

*Primary Examiner* — Jeffrey Allen
*Assistant Examiner* — Jennifer Castriotta
(74) *Attorney, Agent, or Firm* — Carlson, Gaskey & Olds, P.C.

(57) ABSTRACT

A bakery tray includes a base and side walls extending upward from sides of the base, each side wall including an outer side rail and an inner side rail. Side drag rails extend downward from the base proximate sides of the base, with feet projecting outward from the side drag rails. An outer rib projects downward from an outer edge of each of the feet such that the side drag rail of an identical upper tray being stacked on the bakery tray contacts the flanges while the outer ribs of the upper tray are received between the outer side rail and the inner side rail. In another feature, the side walls include handle openings, the handle openings each partially defined by a convex outer wall. In another feature, an upper edge of the front wall includes finger corrugations for accommodating the fingers of a user's hand grasping the tray.

12 Claims, 14 Drawing Sheets

Related U.S. Application Data

(60) Provisional application No. 61/444,692, filed on Feb. 18, 2011, provisional application No. 61/472,520, filed on Apr. 6, 2011.

(56) References Cited

U.S. PATENT DOCUMENTS

| | | | | | |
|---|---|---|---|---|---|
| 5,035,326 | A * | 7/1991 | Stahl | B65D 21/041 | 206/505 |
| 5,344,022 | A * | 9/1994 | Stahl | B65D 21/041 | 206/505 |
| 6,260,706 | B1 * | 7/2001 | Koefelda | B65D 21/041 | 206/505 |
| 6,273,259 | B1 * | 8/2001 | Stahl | B65D 21/046 | 206/509 |
| 6,394,274 | B1 * | 5/2002 | Cheeseman | B65D 21/045 | 206/503 |
| 7,686,167 | B1 * | 3/2010 | Stahl | B65D 21/045 | 206/507 |
| 2003/0183549 | A1 * | 10/2003 | Verna | B65D 21/045 | 206/509 |
| 2005/0183980 | A1 * | 8/2005 | Fernandez | B65D 21/043 | 206/509 |
| 2006/0070906 | A1 * | 4/2006 | Verna | B65D 21/041 | 206/509 |
| 2007/0187276 | A1 * | 8/2007 | Stahl | B65D 21/0233 | 206/505 |
| 2007/0187420 | A1 * | 8/2007 | Gruskin | B65D 25/2897 | 220/771 |
| 2008/0116100 | A1 * | 5/2008 | Hassell | B65D 1/34 | 206/507 |
| 2010/0084304 | A1 * | 4/2010 | Cavalcante | B65D 21/046 | 206/509 |

* cited by examiner

BAKERY TRAY

This application claims priority to U.S. Provisional Application Ser. Nos. 61/472,520 filed Apr. 6, 2011 and 61/444,692 filed Feb. 18, 2011.

BACKGROUND

Some bakery trays include a base and side walls extending upward from sides of the base. Front and rear walls extend upward from the base. The front and rear walls are shorter than the side walls. Flanges extend inward from each of the side walls along the front wall.

Feet extend outward from each side wall. The feet are arranged such that they can stack at a first height on the side walls of an identical tray in a first orientation and at a second height on the identical in a second orientation.

SUMMARY

A bakery tray according to one embodiment of the present invention includes a base and side walls extending upward from sides of the base, each side wall including an outer side rail and an inner side rail. A front wall extends upward from the base. The front wall is shorter than the side walls. A rear wall extends upward from the base. Flanges extend inward from each of the side walls along the front wall.

According to one feature of the bakery tray, side drag rails extend downward from the base proximate sides of the base, with feet projecting outward from the side drag rails. An outer rib projects downward from an outer edge of each of the feet. The outer rib is aligned between the outer side rail and the inner side rail, such that the side drag rail of an identical upper tray being stacked on the bakery tray contacts the flanges while the outer ribs of the upper tray are received between the outer side rail and the inner side rail.

In another, independent feature of the bakery tray, the side walls extend upward from sides of the base. The side walls are taller than the front wall. The side walls include handle openings, the handle openings each partially defined by a convex outer wall.

In another, independent feature of the bakery tray, the side walls extend upward from sides of the base. An upper edge of the front wall includes finger corrugations for accommodating the fingers of a user's hand grasping the tray.

DETAILED DESCRIPTION OF THE PREFERRED EMBODIMENT

Figure 1:
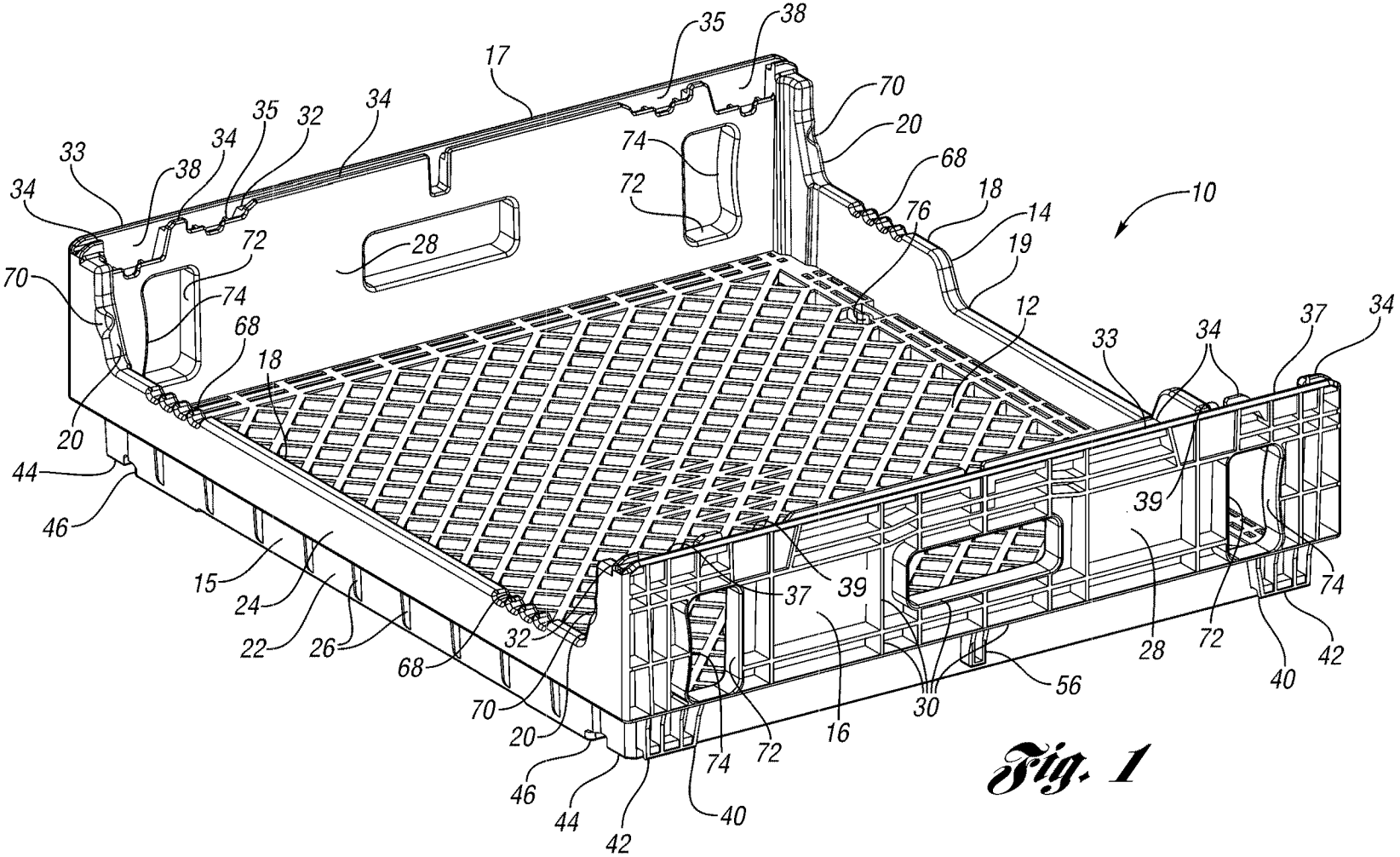
FIG. 1 is a perspective view of a tray according to one embodiment of the present invention.

A bakery tray 10 according to one embodiment of the present invention is shown in FIG. 1. The bakery tray 10 includes a base 12, which may be a grid or lattice of interconnected ribs, a front wall 14, a rear wall 15, and side walls 16 and 17. The front wall 14 and rear wall 15 each include an upper edge 18, which is lower than the side walls 16, 17. In the front wall 14, a cut-out portion 19 of reduced height is formed to provide easier access to the interior of the tray 10. Side flanges 20 extend inwardly into the front wall 14 and rear wall 15 from the side walls 16, 17.

Each of the side walls 16, 17 includes an interior wall portion 28 and a plurality of ribs 30 projecting outwardly therefrom. The side walls 16, 17 include an upper support surface 32 from which projects an outer side rail 33 and an inner side rail 34, which is interrupted to accommodate closely-spaced, high feet receiving pockets 35 and widely-spaced low feet receiving pockets 38 on side wall 17 and widely-spaced, high feet receiving pockets 37 and closely-spaced, low feet receiving pockets 39 on side wall 16.

The side wall 16 includes a pair of widely-spaced feet 40 each having an outer rib 42 projecting downwardly from an outer edge thereof. The feet 40 are generally aligned with the high feet receiving pockets 37. The side walls 16, 17 each include a lower wall portion 44 (or drag rail) from which the feet 40, 41 (FIG. 2) project outwardly. A channel 46 is defined inwardly of each lower wall portion 44.

On the side walls 16, 17 in the center between the feet 40, 41, a center projection 56 protrudes outwardly.

Referring to FIG. 1, the rear wall 15 includes an interior wall portion 22 and a lip 24 extending downwardly from the upper edge 18 of the rear wall 15. A plurality of vertical ribs 26 protrude from the outer surface of the interior wall portion 22 and into the lip 24.

Referring to FIG. 1, the tray 10 includes a number of recesses and contours to make grasping the tray 10 more comfortable and to provide an indication of where and how to grasp the tray 10 in different ways.

First, the flanges 20 each include a thumb recess 70. Vertical grips 72 in the side walls 16, 17 adjacent the front and rear walls 14, 15 include convex 74 outer contoured walls for more comfortably engaging the hand. This feature is based on improving tray 10 disengagement and pivoting from the nested position to the sliding position. This style of grip is particularly useful when the trays 10 are stacked vertically to chest level and above. When the corner of the tray 10 is gripped one can disengage, pull and push the tray 10 in the sliding position with ease.

Figure 2:
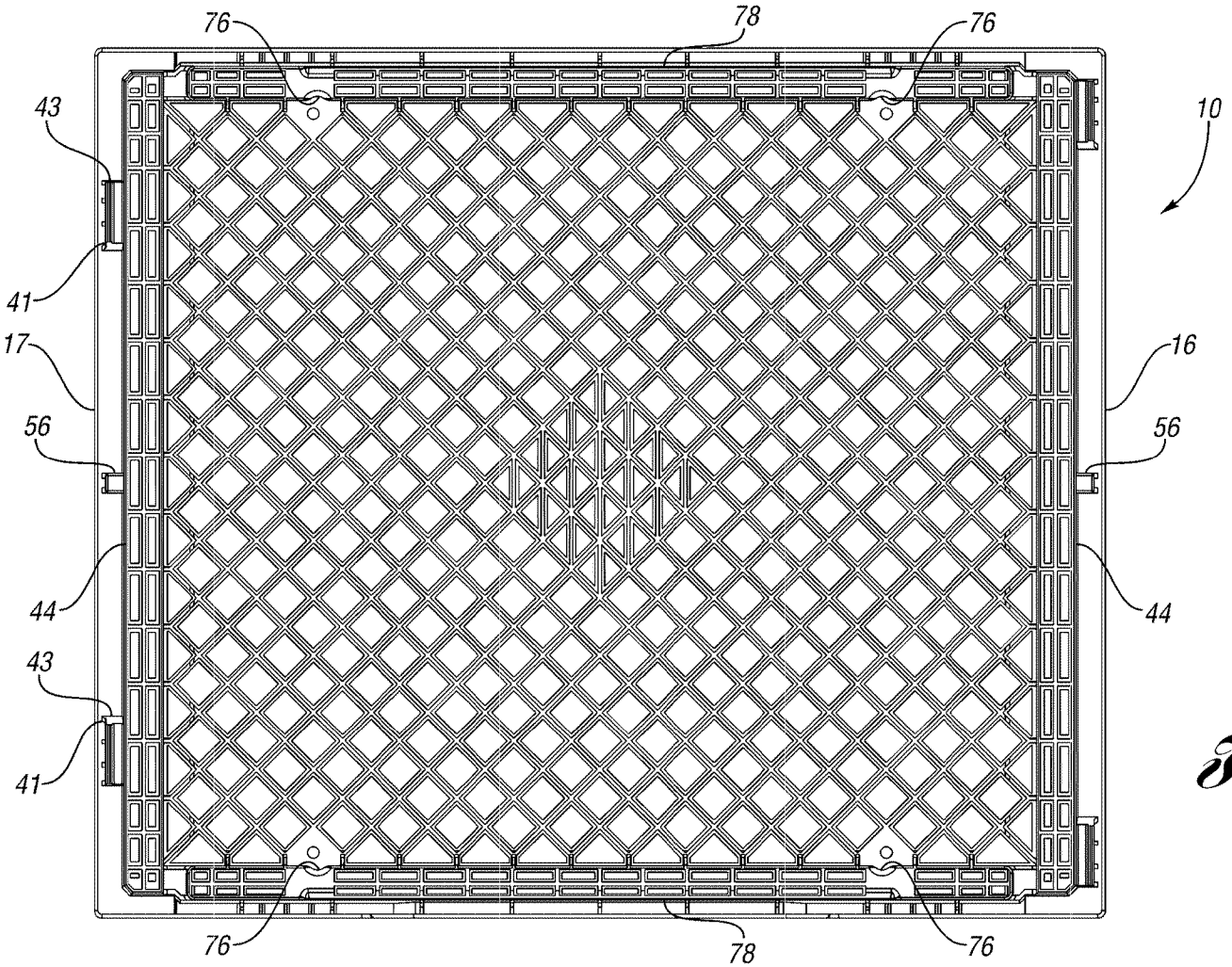
FIG. 2 is a bottom view of the tray of FIG. 1.

Additionally, the upper edges 18 of the front and rear walls 14, 15 include a series (e.g. four) of corrugations 68 or recesses adjacent the flanges 20 for receiving the fingers of a hand grasping the front or rear walls 14, 15. Referring to FIGS. 1 and 2, the tray 10 also includes thumb recesses 76 formed in the interior wall of drag rails 78 at the front and rear of the tray 10. These features work together in a similar fashion to the vertical grips 72 and thumb recess 70, but is another alternative based on personal preference. Functionally it supports the same movement of improving tray 10 disengagement and pivoting from the nested position to the sliding position. This style of grip is particularly useful when the trays 10 are stacked vertically to chest level and above.

When the long wall of the tray 10 is gripped one can disengage, pull and push the tray 10 in the sliding position with ease.

Referring to FIG. 2, the side wall 17 includes a pair of closely-spaced feet 41 each having an outer rib 43 projecting downwardly from an outer edge thereof. The feet 41 are generally aligned with the high feet receiving pockets 35.

Figure 3:
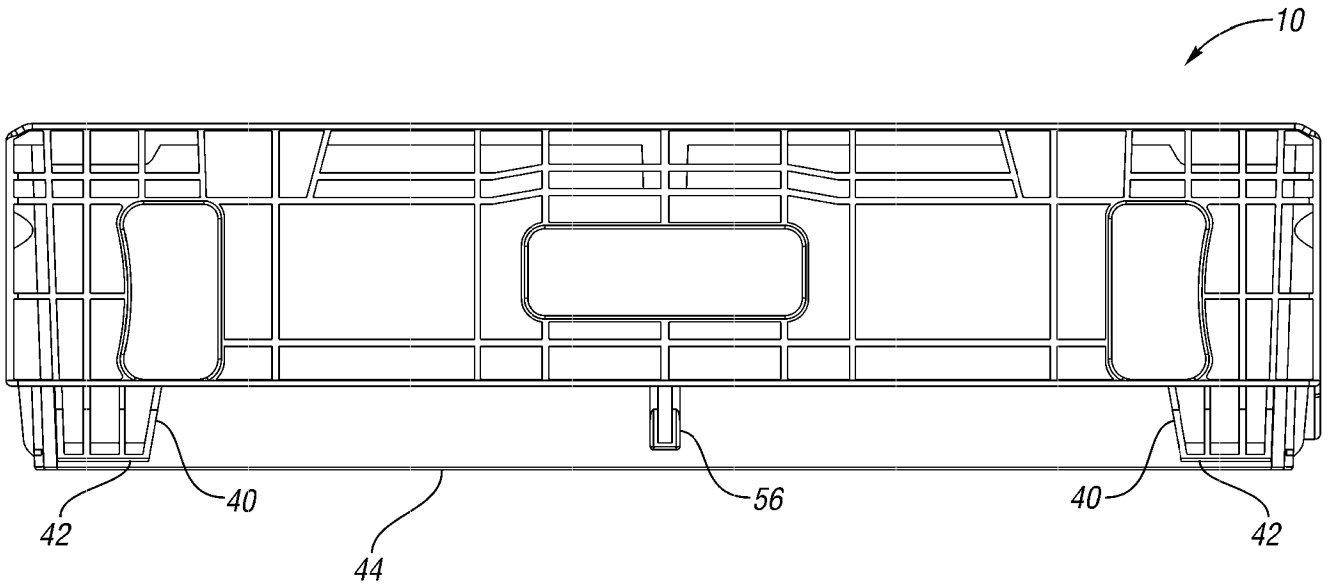
FIG. 3 is a side view of the tray of FIG. 1.

As can be seen in FIG. 3, the feet 40 and center projection 56 are located above a plane of the lowermost edge of the lower wall portion 44 to protect the feet 40 and center projection 56 from damage.

Figure 4:
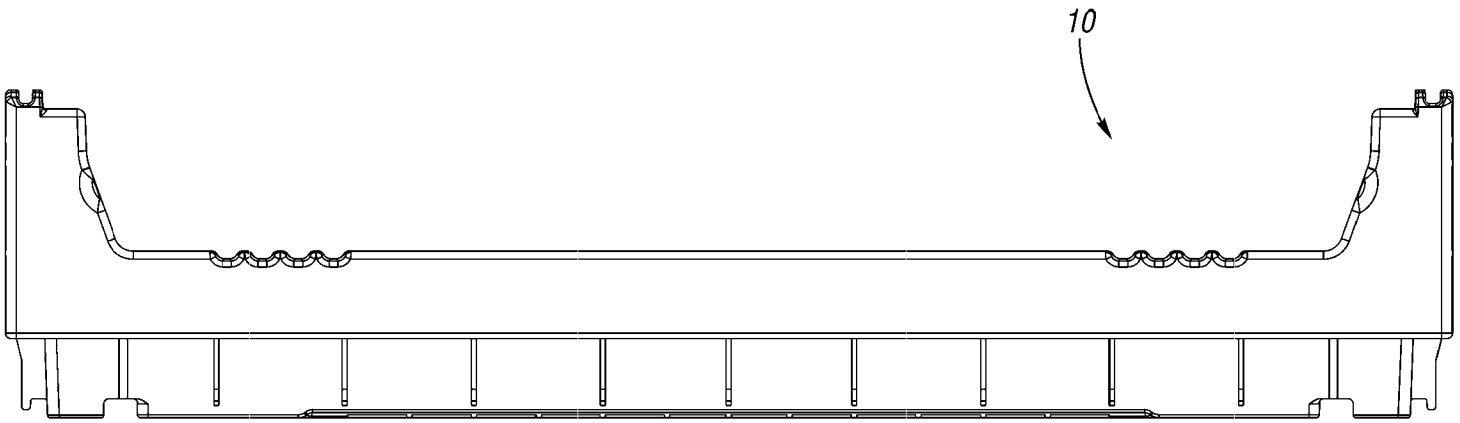
FIG. 4 is a rear view of the tray of FIG. 1.
Figure 5:
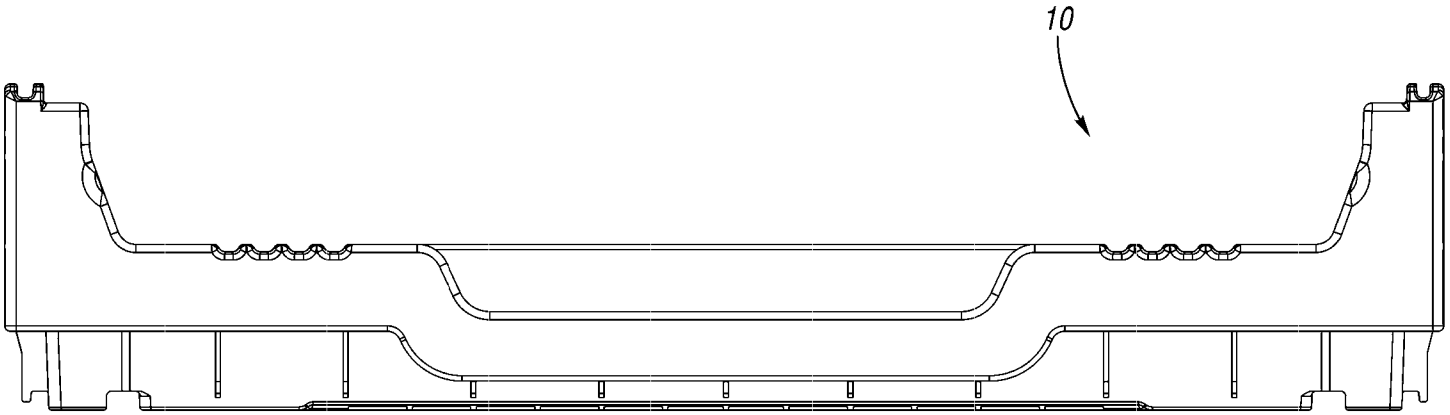
FIG. 5 is a front view of the tray of FIG. 1.
Figure 6:
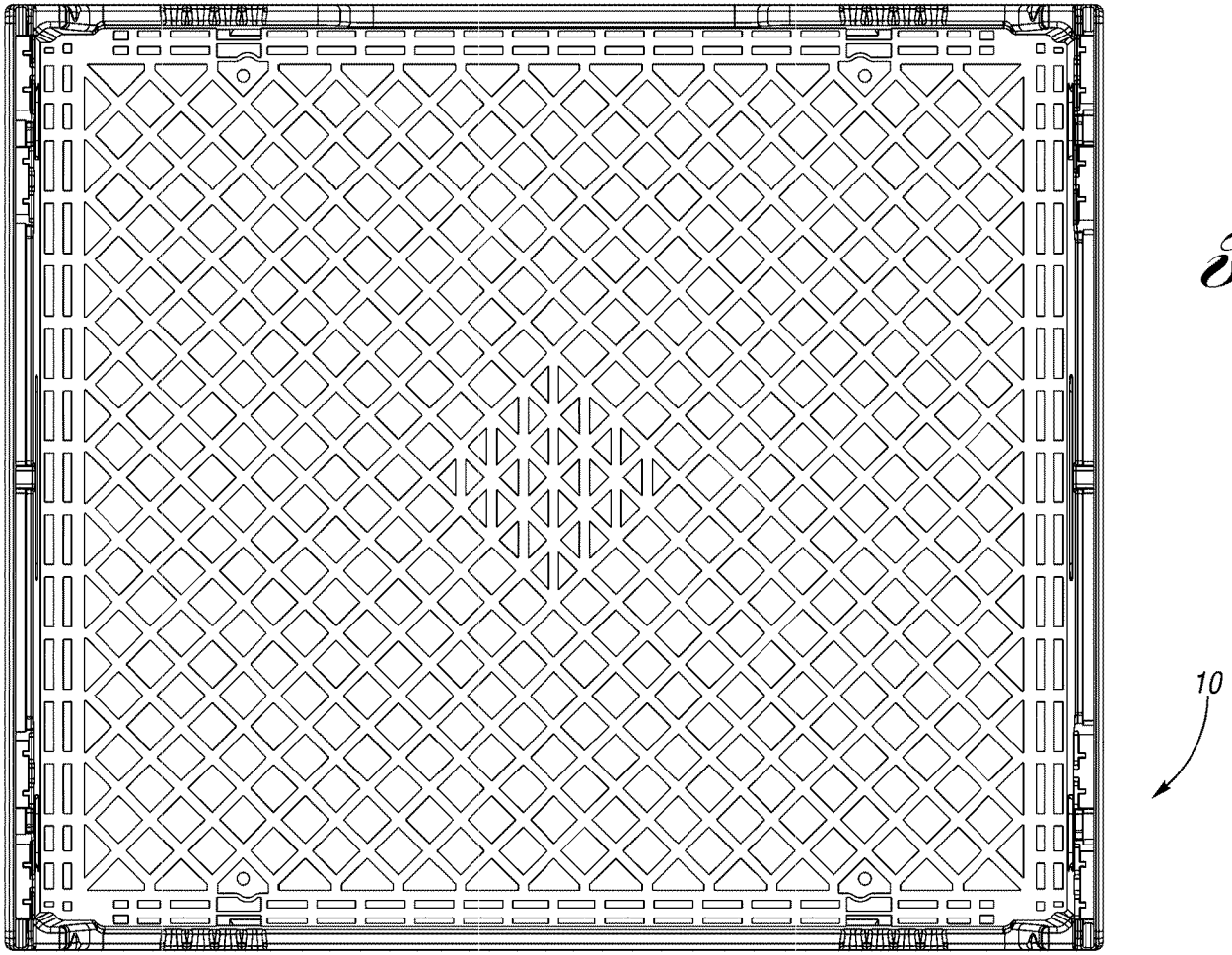
FIG. 6 is a top view of the tray of FIG. 1.

FIG. 4 is a rear view of the tray 10. FIG. 5 is a front view of the tray 10. FIG. 6 is a top view of the tray 10.

Figure 7:
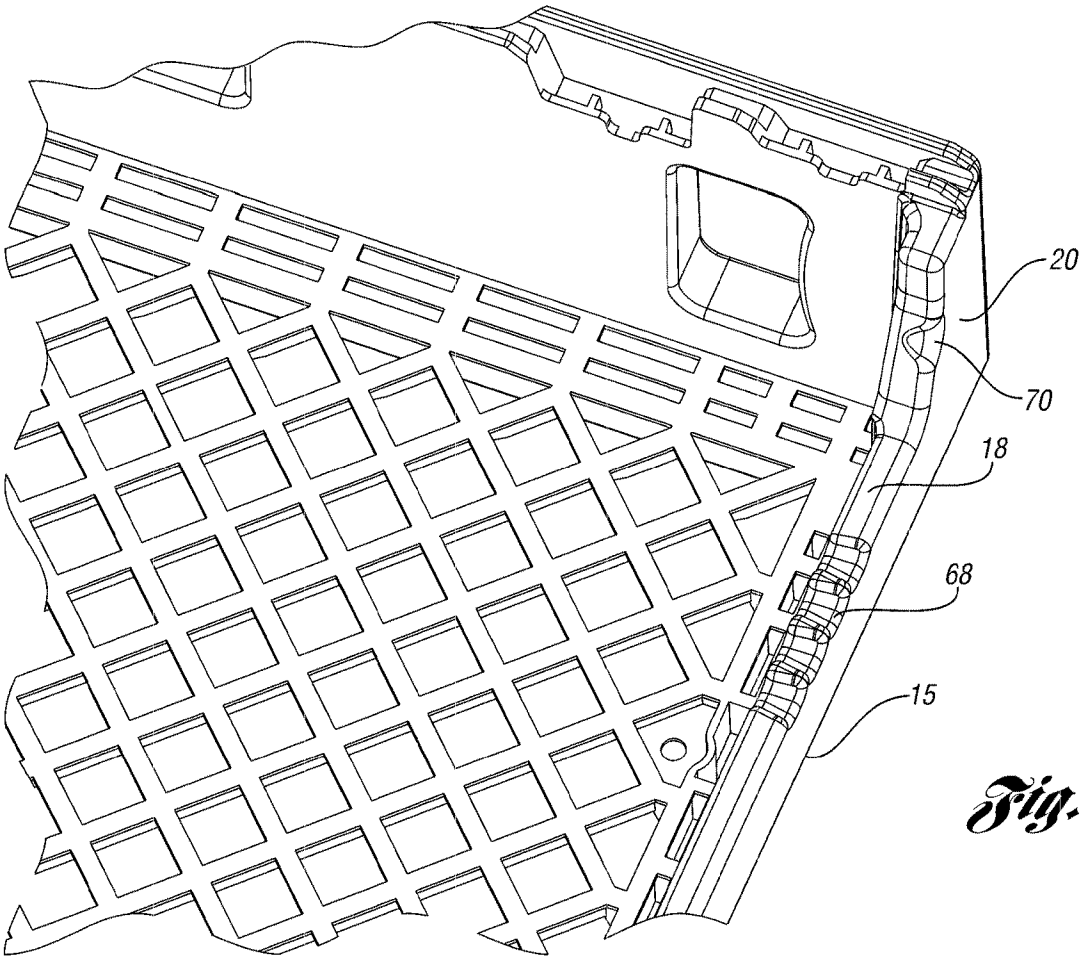
FIG. 7 is an enlarged interior perspective view of one corner of the tray of FIG. 1.
Figure 8:
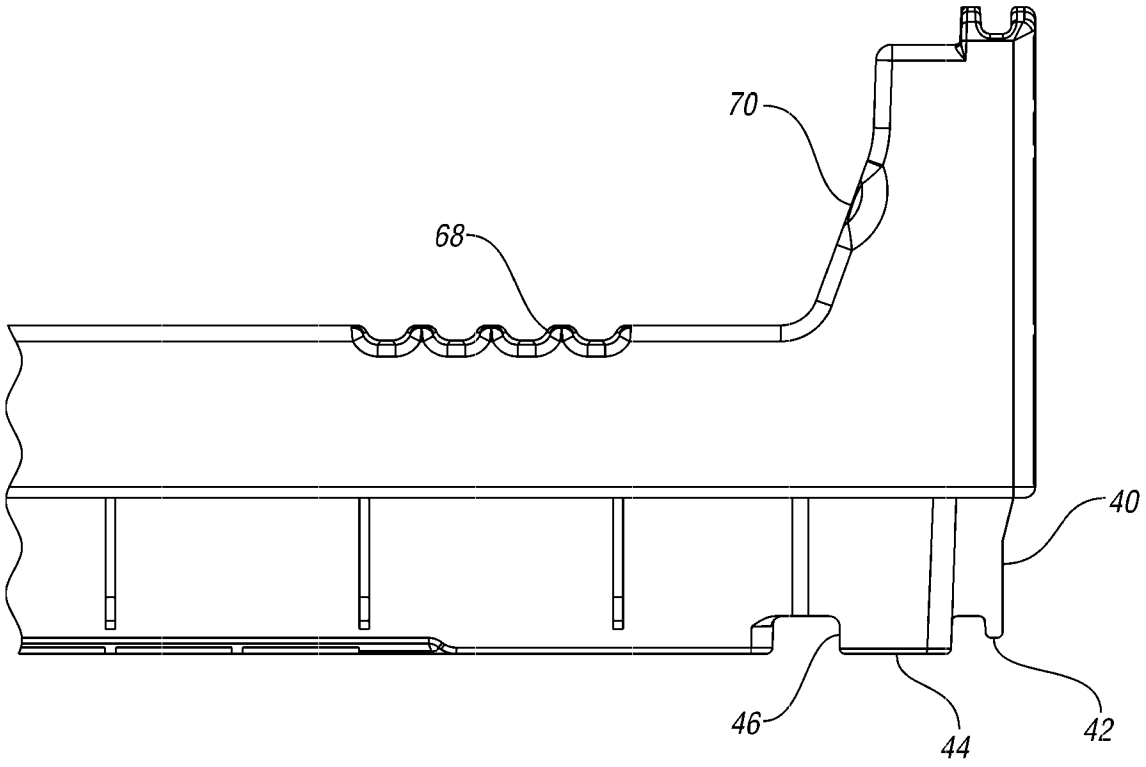
FIG. 8 is an exterior view of the corner of the tray of FIG. 7.

FIGS. 7 and 8 are enlarged views of one corner of the tray 10 illustrating the finger corrugations 68 and the thumb recess 70. FIG. 8 also illustrates the drag rail 44, recess 46, foot 40 and outer rib 42.

Figure 9:
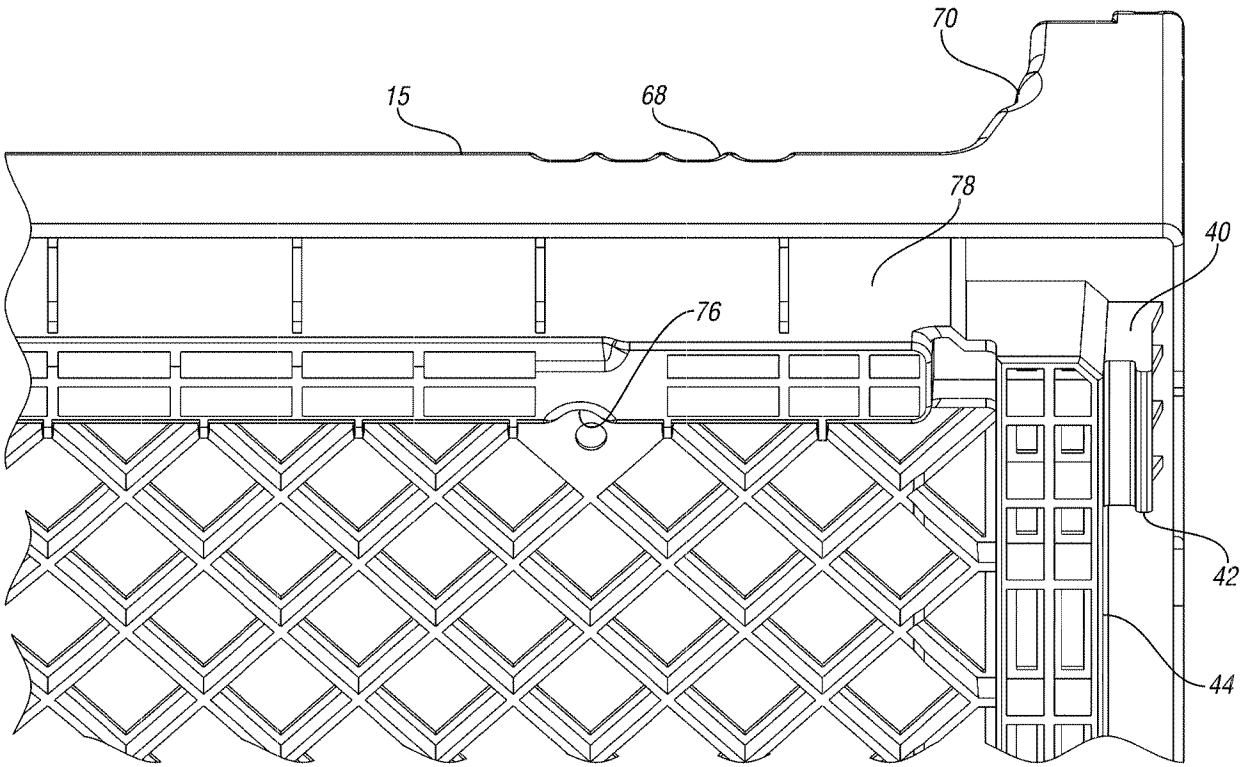
FIG. 9 is a bottom perspective view of the corner of FIGS. 7 and 8.

FIG. 9 is a bottom perspective view of the corner of FIGS. 7 and 8, also showing the thumb recess 76 formed in the rear drag rail 78. As shown, the front and rear drag rails 78 include spaced apart inner and outer walls, separated by transverse ribs, and the thumb recess 76 is formed on an interior surface and bottom surface of the inner wall.

As is known, multiple trays 10 can be stacked on one another at one height in one orientation or at another height by rotating the upper tray 10 180 degrees relative to the lower tray 10.

Figure 10:
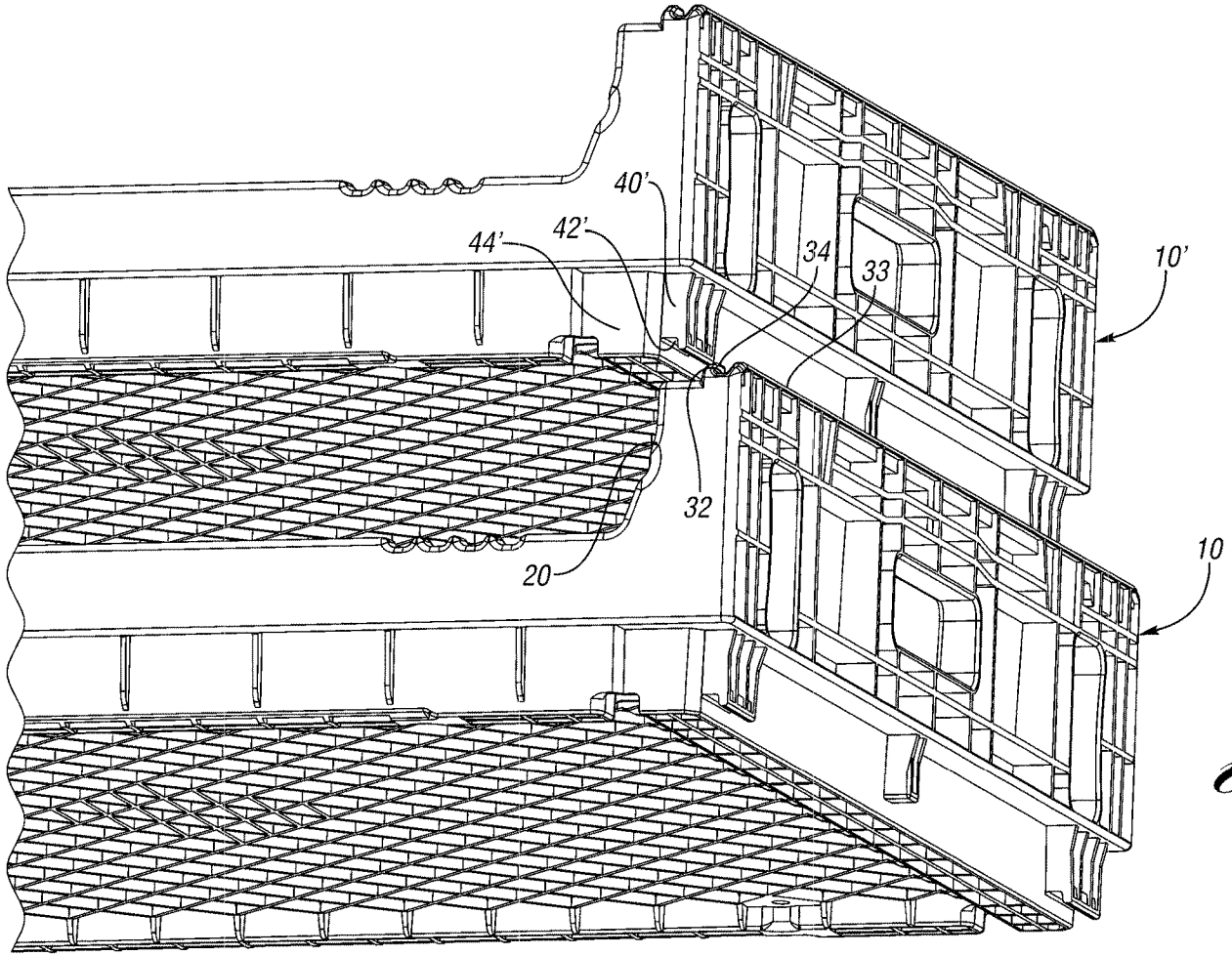
FIG. 10 is a bottom rear perspective view of the tray of FIG. 1 with an identical tray being slid onto it.
Figure 11:
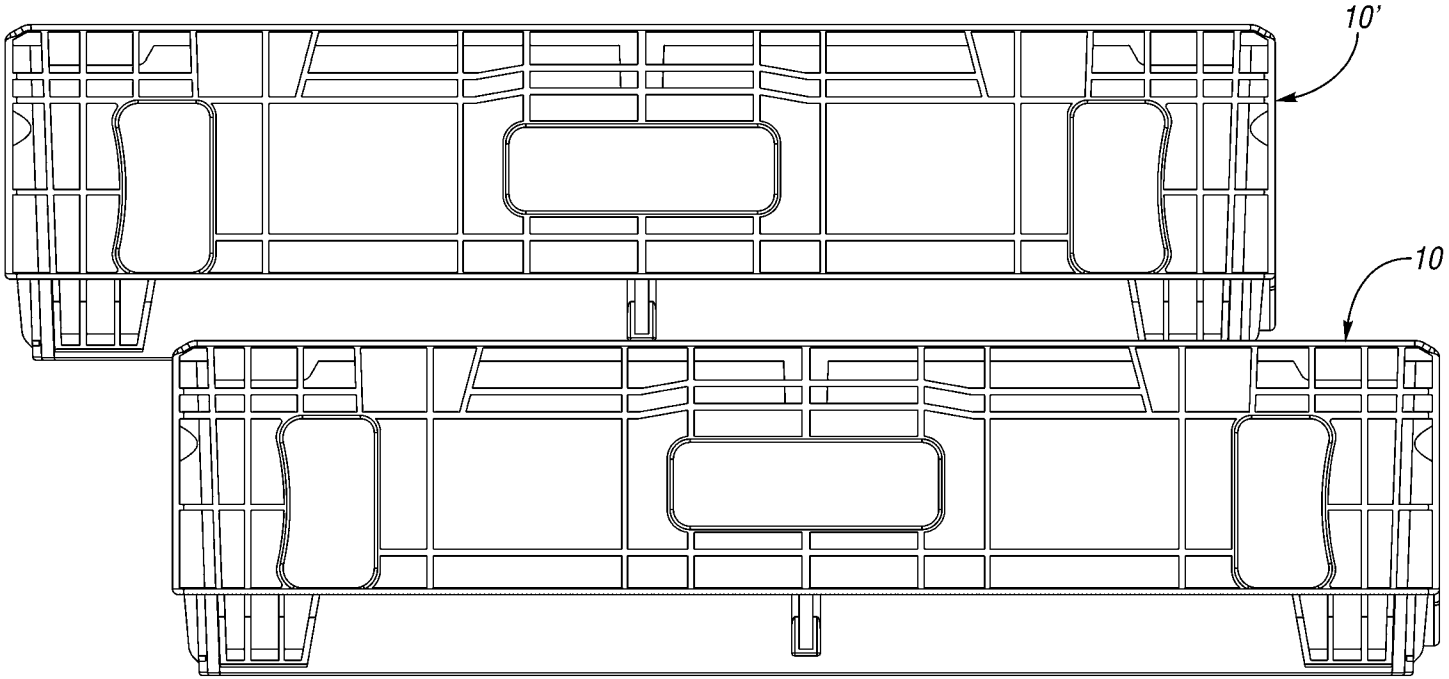
FIG. 11 is a side view of the trays of FIG. 10.
Figure 12:
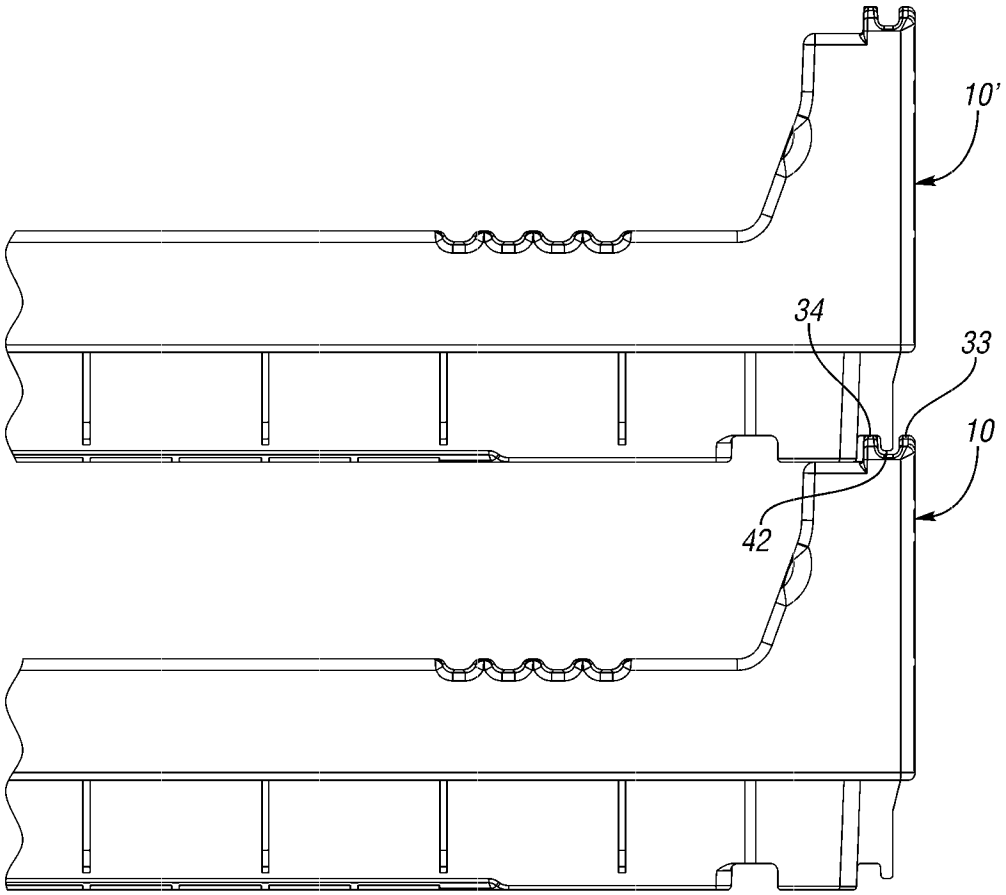
FIG. 12 is an enlarged rear view of one corner of the trays of FIG. 10.
Figure 13:
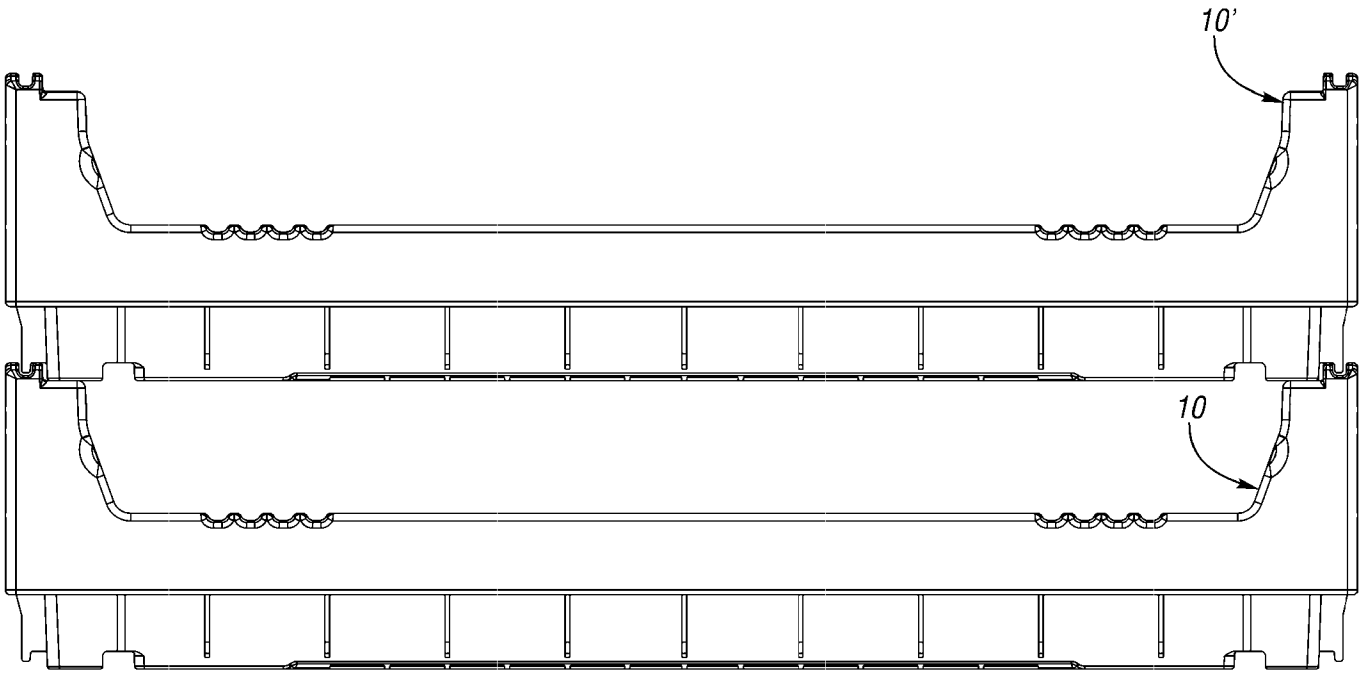
FIG. 13 is a rear view of the trays of FIG. 10.

FIGS. 10-13 show the tray 10 with an identical tray 10' being stacked thereon. As shown in FIG. 10, the drag rail 44' of the upper tray 10' is received on the upper edge of the flange 20, abutting the inner rail 34. The inner rail 34 is received between the drag rail 44' and the outer rib 42' of the foot 40'. The outer rib 42' of the foot 40' abuts the outer rail 33 of the lower tray 10. This provides for more stable slide stacking of the trays 10, 10'. The drag rail 44' may include spaced apart inner and outer walls, separated by transverse ribs, as shown.

The tray is integrally molded as a single piece of plastic.

Figure 14:
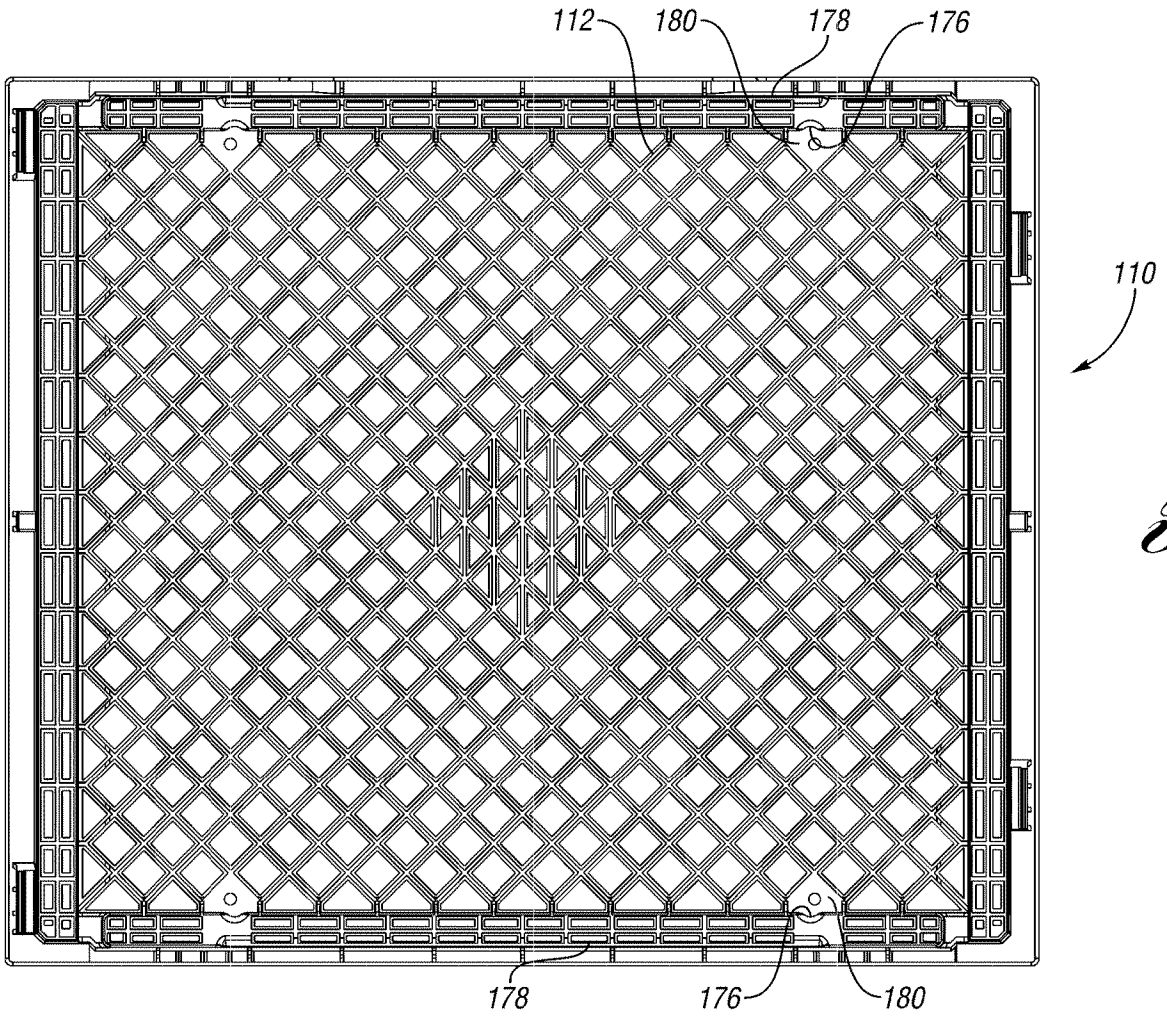
FIG. 14 is a bottom view of a tray according to a second embodiment.

FIG. 14 is a bottom view of a tray 110 according to a second embodiment. The tray 110 is identical to the tray 10 of FIGS. 1-13 except as described below or shown in the drawings. The tray 110 includes the front and rear drag rails 178 with the thumb recesses 176 as before. The base 112 includes a wall 180 closing the lattice opening immediately adjacent each thumb recess 176. This prevents the user's thumb from slipping into the lattice opening in the base 112.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A bakery tray comprising:

a base;

side walls extending upward from sides of the base, each side wall including an outer side rail and an inner side rail;

a front wall extending upward from the base, the front wall being shorter than the side walls;

a rear wall extending upward from the base;

flanges extending inward from each of the side walls along the front wall, the flanges each having an uppermost surface inward of the respective inner side rail;

side drag rails extending downward from the base proximate sides of the base, wherein the side drag rails each include spaced apart walls having transverse ribs therebetween, feet projecting outward from the side drag rails, an outer rib projecting downward from an outer edge of each of the feet, the outer rib aligned between the outer side rail and the inner side rail, such that the side drag rails of an identical upper tray being stacked on the bakery tray contact the uppermost surfaces of the flanges while the outer ribs of the upper tray are received between outer side rail and the inner side rail.

2. The bakery tray of claim 1 wherein the side drag rails have lowermost surfaces that are the lowermost surfaces of the bakery tray.

3. The bakery tray of claim 2 wherein the rear wall is shorter than the side walls.

4. The bakery tray of claim 3 wherein the feet are arranged such that the feet of the identical tray stack on the side walls of the tray at a first height in a first orientation and at a second height in a second orientation 180 degrees from the first orientation.

5. A bakery tray comprising:

a base;

a front wall extending upward from the base, wherein the front wall includes a central portion of reduced height between outer portions of the front wall;

a rear wall extending upward from the base;

side walls extending upward from sides of the base, the side walls being taller than the front wall; and side flanges extending inward from the side walls along an upper edge of the outer portions of the front wall, the upper edge of the outer portions of the front wall including finger corrugations for accommodating the fingers of a user's hand grasping the tray, wherein the finger corrugations on each outer portion of the front wall include a plurality of recesses formed in the upper edge.

6. The tray of claim 5 further including side drag rails extending downward from the base proximate sides of the base, feet projecting outward from the side drag rails, wherein the feet are arranged such that the feet of an identical tray stack on the side walls of the tray at a first height in a first orientation and at a second height in a second orientation 180 degrees from the first orientation.

7. The tray of claim 6 further including a front drag rail including thumb recesses for accommodating a thumb of a user's hand while the fingers of the user's hand are received in the finger corrugations.

8. The tray of claim 7 wherein the front drag rail includes an inner rail spaced apart from an outer rail, the thumb recesses formed on the inner rail.

9. The tray of claim 8 wherein the base includes a lattice and wherein a lattice opening adjacent the thumb recess on the inner rail is closed by a wall portion.

10. A bakery tray comprising:

a base;

a front wall extending upward from the base;

a rear wall extending upward from the base;

side walls extending upward from sides of the base, the side walls being taller than the front wall, an upper edge of the front wall including finger corrugations for accommodating the fingers of a user's hand grasping the tray;

side drag rails extending downward from the base proximate the sides of the base, feet projecting outward from the side drag rails, wherein the feet are arranged such that the feet of an identical tray stack on the side walls of the tray at a first height in a first orientation and at a second height in a second orientation 180 degrees from the first orientation; and a front drag rail including thumb recesses for accommodating a thumb of a user's hand while the fingers of the user's hand are received in the finger corrugations.

11. The tray of claim 10 wherein the front drag rail includes an inner rail spaced apart from an outer rail, the thumb recesses formed on the inner rail.

12. The tray of claim 11 wherein the base includes a lattice and wherein a lattice opening adjacent the thumb recess on the inner rail is closed by a wall portion.

* * * * *